United States Patent [19]

Dietrich

[11] 4,254,648

[45] Mar. 10, 1981

[54] INNER LOCKING CYLINDER WITH CAPTIVE KEY

[75] Inventor: Hagen Dietrich, Delta, Canada

[73] Assignee: Norris Industries, Inc., Long Beach, Calif.

[21] Appl. No.: 13,229

[22] Filed: Feb. 21, 1979

[51] Int. Cl.[3] ..... E05B 11/00

[52] U.S. Cl. ..... 70/380; 70/389; 70/DIG. 60

[58] Field of Search ..... 70/389, 379 R, 380, 70/120, 134, DIG. 60

[56] References Cited

U.S. PATENT DOCUMENTS 4,109,496 8/1978 Allemann ..... 70/380

*Primary Examiner*—Robert L. Wolfe

*Attorney, Agent, or Firm*—Vernon D. Beehler

[57] ABSTRACT

A dead bolt lock set is designed to be key actuated on the inside as well as on the outside of the door. For the inside there is an inside tailpiece in engagement with a drive slot in the dead bolt hub. A lost motion circumferential recess on the inside tailpiece provides stops at positions such that when the key is inserted on the inside and turned to lock the dead bolt by action of a micro drive pin, the key cannot be returned in reverse direction to key release position without unlocking the dead bolt. Consequently, the key must remain captive in the inside keyway to keep the dead bolt locked because of being held in the cylinder by the pin tumblers.

When the lock has been locked from the outside, the drive slot in the head of the tailpiece is rotated out of line with the inside key slot. Under this condition when unlocking from the inner trim, the tailpiece and washer are forced inward by the key tip compressing the conical spring and allowing full key insertion. Bolt retraction (unlocking) may be accomplished by rotation of the key in the bolt extended direction until the key tip aligns with the tailpiece drive slot, then rotating the key back to the vertical (withdrawn) position, or, in the alternative, rotating the key in the retract direction, whereby the micro pin contacts the lost motion stop on the tailpiece head thereby driving the mechanism to the retracted position. The captive key mechanism is fail safe in that in the event the conical spring fails to return the tailpiece to a position abutting the end of cylinder plug for captive key operation, the mechanism will still function as a standard cylinder allowing normal locking and unlocking.

7 Claims, 20 Drawing Figures

Fig. 10.
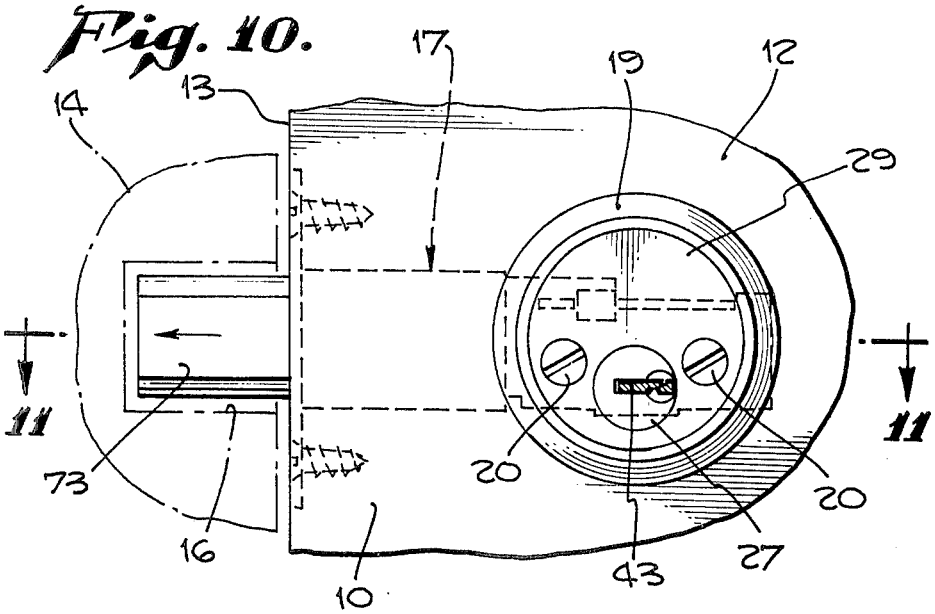
Fig. 11.
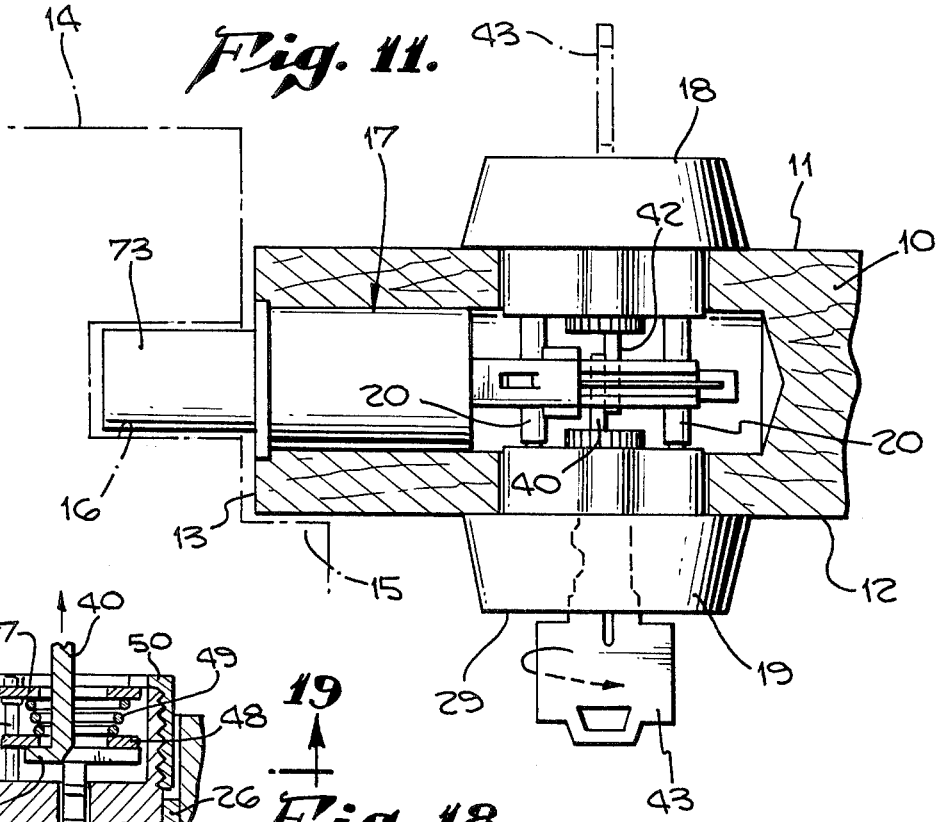
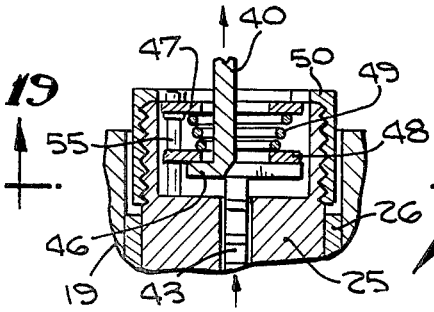
Fig. 18.

Fig. 16.
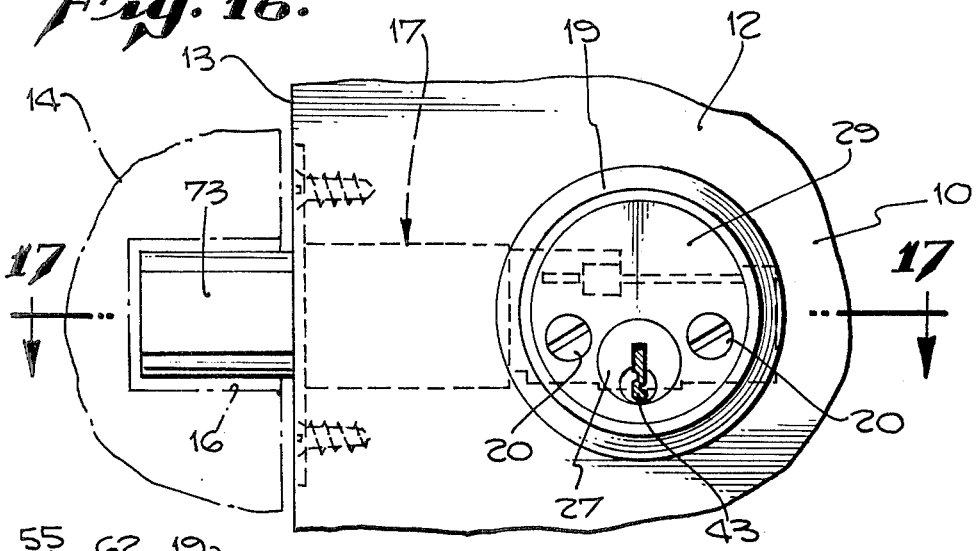
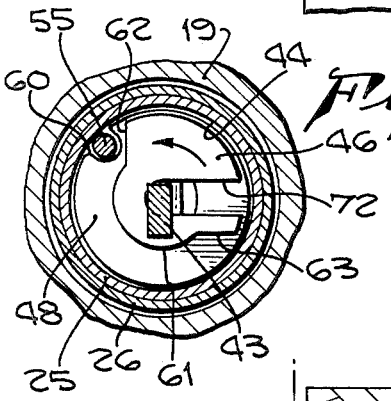
Fig. 19.
Fig. 17.
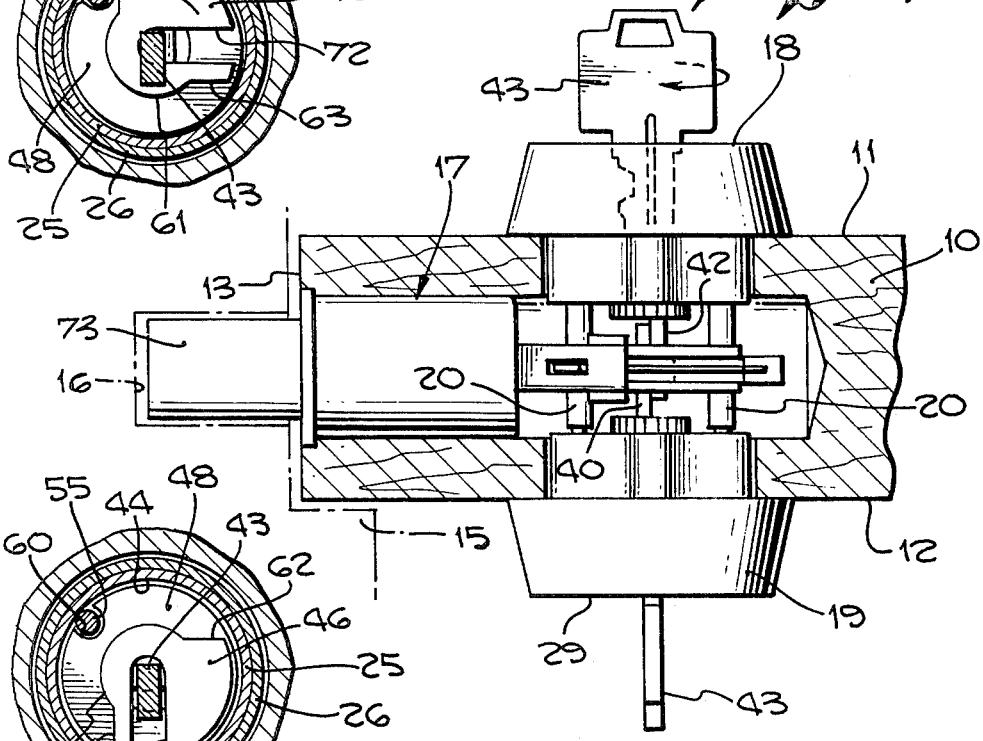
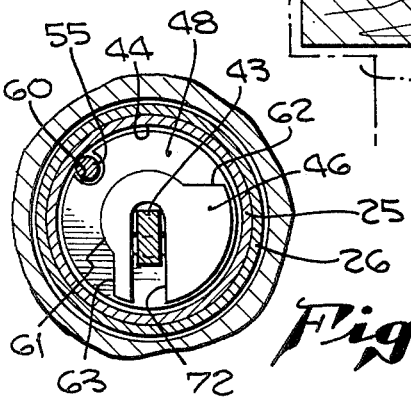
Fig. 20.

INNER LOCKING CYLINDER WITH CAPTIVE KEY

Dead bolt lock sets normally consist of a dead bolt mechanism serving as an additional supplementary lock set for a door, the principle lock being customarily a key in knob door lock where there is a knob on both the outside and inside of the door operating its own latch bolt. The obvious purpose is additional security. From the point of view of external security dead bolt mechanisms heretofore generally available had been acceptable. These consist of a cylinder assembly for the outside of the door manipulated by a conventional key to lock and unlock the dead bolt, and wherein there is a thumb turn for the inside of the door which enables the dead bolt to be either locked or unlocked from the inside without using the key.

More recently, resort has been had to a key actuated cylinder assembly also on the inside of the door, replacing the thumb turn. The reason for making use of a key actuated cylinder assembly for the dead bolt is to prevent an intruder who has made an entry onto the premises at some other location from opening the door from the inside and thereby more easily remove the contents of the premises. It is assumed, of course, that the occupant upon leaving the premises makes use of the only handily available key which, though capable of locking the dead bolt from either the inside or the outside of the door, is carried by the occupant so that the door can be locked from the outside.

Although the employment of a dead bolt lock set necessitating key actuation on the inside is successful in preventing intruders from opening the door from the inside, a dead bolt lock set of this kind presents a safety hazard. Most people habitually remove a key from a door after the lock set has been locked. Such a key may be on a key ring with other keys, or perhaps hung at a location remote from the door which it is intended to operate. As a consequence, in case of a fire on the premises, or other emergency, it is entirely possible that a panic situation would exist creating difficulty and delay in locating the key and then unlocking the lock set. It is of course likely that under such a situation the location of the key might be temporarily forgotten under the stress of circumstance. Even under ordinary circumstances should the key be removed by the occupant after locking the lock set and then leave another person with the responsibility for unlocking the dead bolt lock set, the whereabouts of the key might remain unknown to the other person.

It is therefore among the objects of the invention to provide a new and improved dead bolt lock set provided with an inside locking cylinder wherein the key is held captive whenever the deadbolt is locked from the inside of the door.

Another object of the invention is to provide a new and improved dead bolt lock set featuring an inside locking cylinder having a captive key mechanism such that the key must remain in place on the inside of the door after being used to lock the dead bolt lock set, if the door is to continue to be locked, but which can be readily unlocked by use of a duplicate key on the outside.

Still another object of the invention is to provide a new and improved dead bolt lock set with an inside locking cylinder having a captive key, of such construction that should the dead bolt lock set be initially locked from the outside of the door, an occupant of the building on the inside of the door with a duplicate appropriate key can quickly and readily unlock the dead bolt lock set from the inside.

Still another object of the invention is to provide a new and improved inside locking cylinder with captive key for a dead bolt lock set which makes use of a substantial number of the conventional expedients for an inside cylinder locking mechanism wherein the key is not captive thereby to maintain such a captive key mechanism substantially similar in its construction, while at the same time taking the full advantage of the safety features inherent in the captive key construction.

Still further among the objects of the invention is to provide a new and improved inside locking cylinder for a dead bolt lock set wherein the key is captive upon being locked from the inside of the door, the parts of the inside lock set being capable of rugged fail safe construction while at the same time being kept relatively simple in view of cost.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 10, is a side elevational view similar to FIG. 1, but with the dead bolt extended to locked position.

FIG. 11, is a sectional view on the line 11—11 of FIG. 10

FIG. 16, is a view similar to FIG. 10, but wherein the dead bolt has been locked by key actuation from the outside.

FIG. 17, is a sectional view taken on the line 17—17 of FIG. 16.

FIG. 18, is a fragmentary longitudinal sectional view showing parts in the position of FIG. 16.

FIG. 19, is a fragmentary cross-sectional view similar to FIG. 15 and taken on the line 19—19 of FIG. 18.

FIG. 20, is a fragmentary cross-sectional view similar to FIGS. 15 and 19, showing the parts in the position they would have after a key applied to the inside has been moved into position for unlocking the lock set, showing the position of parts after a key inserted in the cylinder mechanism on the inside as being rotated into alignment for unlocking the latch bolt.

Figure 1:
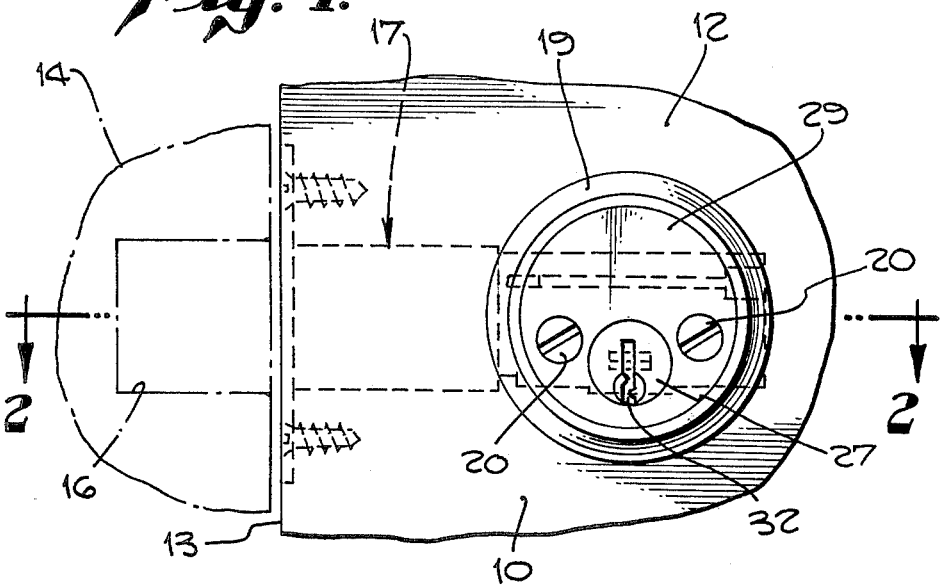
FIG. 1, is a side elevational view of the lock set in a fragment of door in a door frame viewed from the inside of the door.
Figure 2:
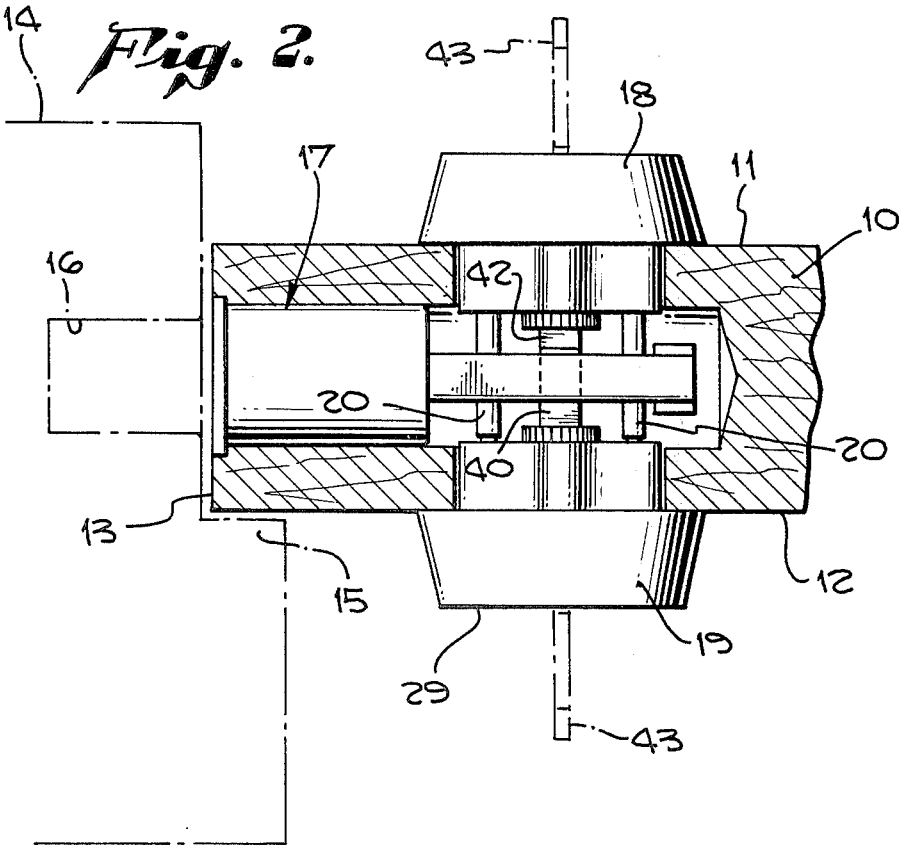
FIG. 2, is a cross-sectional view on the line 2—2 of FIG. 1.

In an embodiment of the invention chosen for the purpose of illustration there is shown a fragment of door 10 having an outside face 11 and inside face 12 and an edge face 13. The door is adapted to swing within a frame 14 against a stop 15, there being a dead bolt recess 16 in the door frame 14. For locking the door there is provided a dead bolt sub-assembly 17 adapted to be locked and unlocked from the outside through an outside trim 18, and from the inside through an inside trim 19. The outside and inside trim are fastened together by conventional sleeve and post assemblies 20 which also serve to secure the trims to the door in general alignment with the dead bolt subassembly 17.

Both the outside trim and inside trim in the chosen example are substantially conventional pin tumbler key actuated mechanisms, details of only the inside pin tumbler mechanism being shown. As in FIG. 7, a cylinder plug 25 fits rotatively in cylinder 26 in a manner such that an exterior disc 27, which is part of the cylinder plug, engages an outwardly facing edge 28 of the cylinder 26 with the face of the disc being flush with an outer face 29 of the trim.

Conventional bottom pins 30 operating in pin bores 31 of the cylinder plug 25 are aligned with the keyway 32. Top pins 33 in pin bores 34 on a pin housing 35 are urged into engagement with the bottom pins by springs 36. The pin tumbler mechanism is designed to function with an inside tailpiece 40. The tailpiece is received in a dead bolt deadlocking hub 41 which is part of the dead bolt assembly 17. For the outside trim 18 there is an outside tailpiece 42 which also engages the dead bolt deadlocking hub 41 in side-by-side relationship with the inside tailpiece 40. In this way the dead bolt is locked and unlocked by one or another of the outside trim or inside trim, with the tailpieces acting as a hub actuating means.

A feature of the invention is to have the outside trim and its outside tailpiece 42 operate independently of the inside trim and its inside tailpiece 40, while at the same time, to have a common key 43 captive within the keyway 32 as long as the dead bolt lock is in a locked position.

To provide for a certain amount of freedom of motion of the inside tailpiece 40 relative to the cylinder plug 25, there is provided at the inner end of the cylinder plug a counter bore space 44, slightly larger in diameter than the outermost perimeter 45 of a head 46 at one end of the inside tailpiece 40. Surrounding the inside tailpiece and at a location within the counter bore are two low friction stabilizing washers 47 and 48, and between the washers is a conical coil spring 49, see FIG. 8.

For holding the cylinder plug 25 in position within the cylinder 26 there is provided a micro cap 50, serving as a retainer, having internal threads 51 adapted to engage external threads 52 at the inner end of the cylinder plug 25. Th micro cap 50 also closes the end of the bore 44 thereby to provide a shoulder against which the washer 47 is pressed by action of the spring 49. At the other end the spring 49 presses the washer 48 against the adjacent head 46 of the inside tailpiece.

Figure 3:
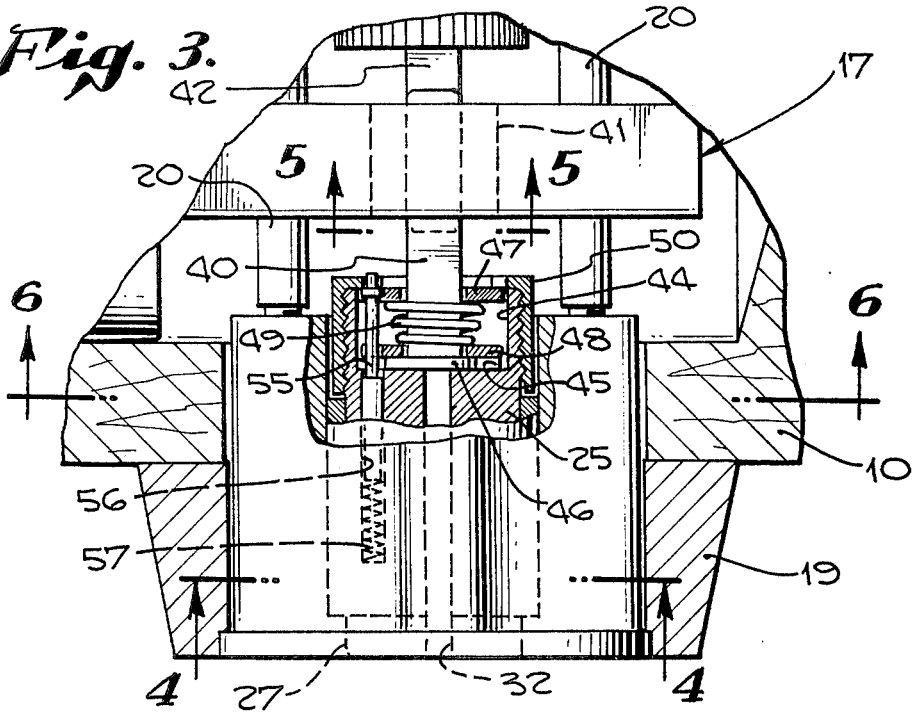
FIG. 3, is a fragmentary sectional view showing the inner locking cylinder assembly partially broken away and with the lock set in retracted or unlocked position.
Figure 5:
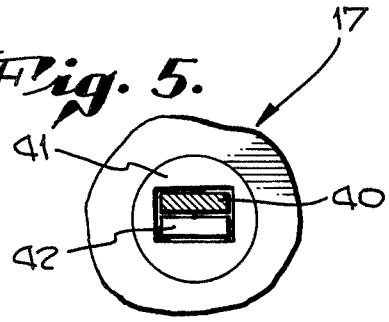
FIG. 5, is a cross-sectional view on the line 5—5 of FIG. 3.

A micro pin 55, serving as a driver, is adapted to be slidably retained in a micro pin bore 56 in the cylinder plug 25, extending into the cylinder plug from the bottom of the counter bore 44. The micro pin is normally urged outwardly relative to the micro pin bore, see FIG. 3, by action of a micro pin spring 57. A tip 58 on the micro pin is adapted to engage one or another of the locking notches 59 in the micro cap 50 so as to lock the cap in assembled position. In order to accommodate the micro pin 55 in the position described, clearance notches 60 are provided in the washers 47 and 48. Also on the head 46 of the inside tailpiece there is a portion of reduced diameter 61 which also accommodates rhe micro pin 55, the portion of reduced diameter providing at opposite ends lost motion stops 62 and 63. The stops are adapted to engage the micro pin in one position or another of the cylinder plug 25 relative to the inside tailpiece 40. A flange 64 near the tip 58 of the micro pin limits its extension outwardly into the appropriate locking notch. A cutaway portion 65 provides additional clearance for the conical coil spring 49.

Figure 4:
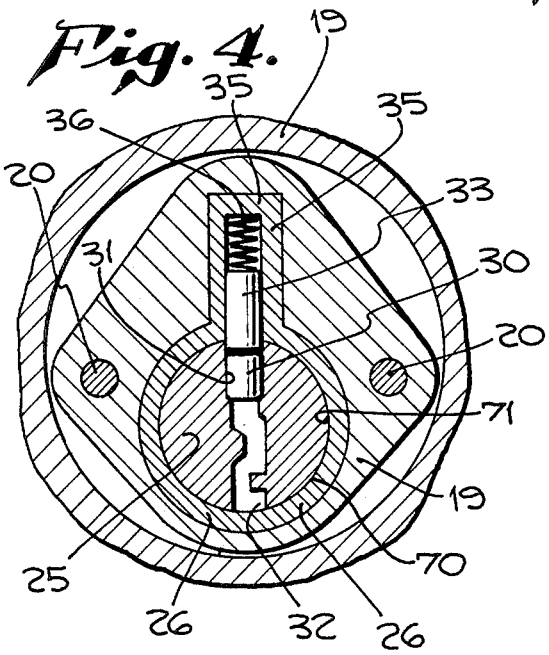
FIG. 4, is a cross-sectional view on the line 4—4 of FIG. 3.
Figure 6:
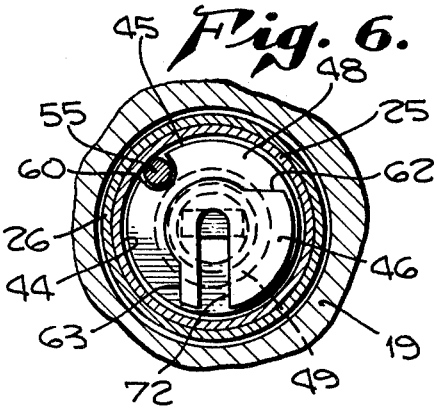
FIG. 6, is a fragmentary cross-sectional view on the line 6—6 of FIG. 3.
Figures 7, 8, 9:
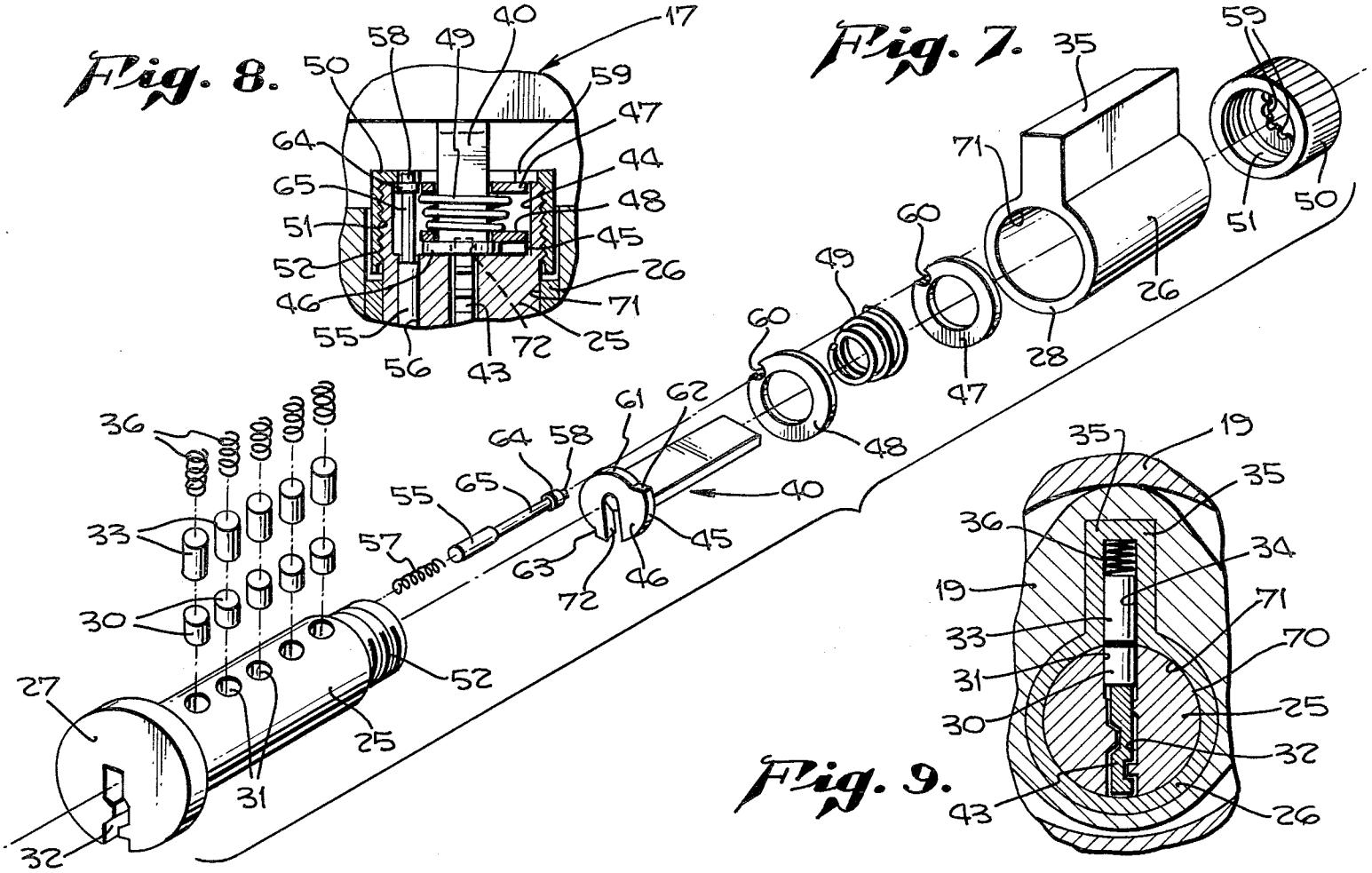
FIG. 7, is an exploded perspective view of the inside locking cylinder mechanism.
FIG. 8, is a fragmentary cross-sectional view similar to FIG. 3 showing the position of parts with a key inserted from the inside of the door.
FIG. 9, is a fragmentary cross-sectional view through the inner locking cylinder showing a key inserted in initial position where it can be inserted or withdrawn.

With the parts in the positions of FIGS. 1 through 9 inclusive, when a properly cut key like the key 43 is inserted into the keyway 32 the pin tumblers are shifted from the position of FIG. 4 to the position of FIG. 9. There the pin tumblers are appropriately shifted so as to coincide with a shear line 70 between the outer circumference of the cylinder plug 25 and the inside of a corresponding bore 71 of the cylinder 26, as shown in FIG. 9. At the same time by pushing the key 43 inwardly to its innermost position the cut end of the key 43 enters a key drive slot 72 in the head 46 of the inside tailpiece 40. As a consequence when the key is rotated, in a counterclockwise direction as viewed in FIGS. 10 to 15, the dead bolt locking hub 41 is likewise rotated counterclockwise from the position of FIG. 5 until a locking end 73 of the dead bolt subassembly enters the dead bolt recess 16. At the end of its rotation the cylinder plug 25 will have the position illustrated in FIG. 13. This means that the bottom pins 30 will be in a position confined by the wall of the bore 71. As a consequence, the key 43 cannot be withdrawn. Because the end of the key is engaged in the key drive slot 72, when the key is rotated from the position of FIG. 13 clockwise it causes the inside tailpiece 40 also to rotate clockwise, thereby to withdraw the locking end 73 of the dead bolt subassembly from its extended locked position, until the key is again in the position of FIG. 9. In that position the key 43 can be withdrawn but the dead bolt is unlocked. As a consequence it will be obvious that if the dead bolt is to remain locked, once having been locked by operation of the inside trim, the key 43 must remain captive.

Let it now be assumed that the door has been closed and the occupant with the same or a duplicate key 43 extends the dead bolt to locked position by operation of the key in the outside trim 18. This is accomplished in the conventional way by having the key drive the plug with subsequent rotation of the outside tailpiece 42 which, by rotating the locking hub 41 extends the dead bolt in the usual manner. During this operation, the inside tailpiece 40, being in engagement with the hub 41, is also rotated, together with the head 46. As a consequence, the key drive slot 72 in the head 46 is rotated to the position of FIGS. 18 and 19 which is out of alignment with the position of the key slot 32. The key 43 thereafter can be returned to initial position in the outside trim 18 and withdrawn in the conventional manner.

Figure 12:
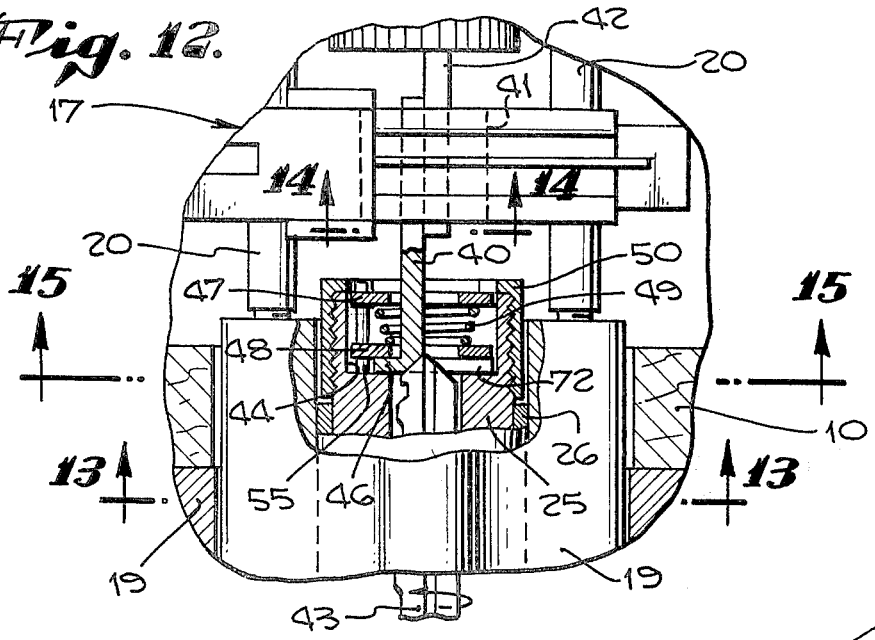
FIG. 12, is a partial view similar to FIG. 11, but with portions broken away to show the key position for locking.
Figure 14:
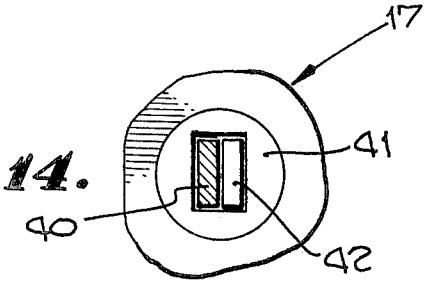
FIG. 14, is a cross-sectional view on the line 14—14 of FIG. 12.
Figure 13:
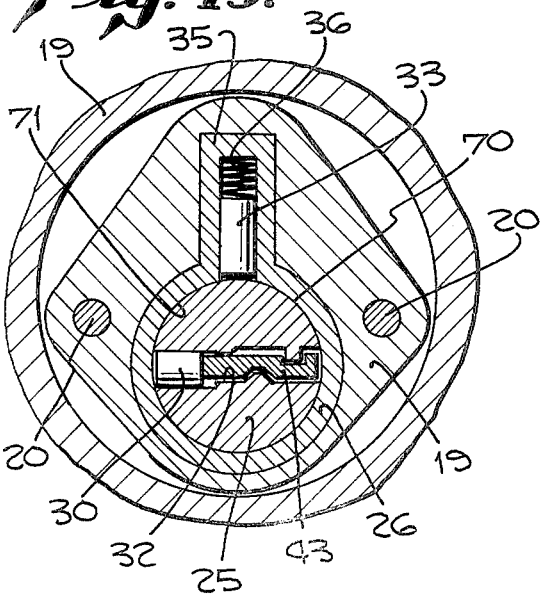
FIG. 13, is a cross-sectional view on the line 13—13 of FIG. 12.
Figure 15:
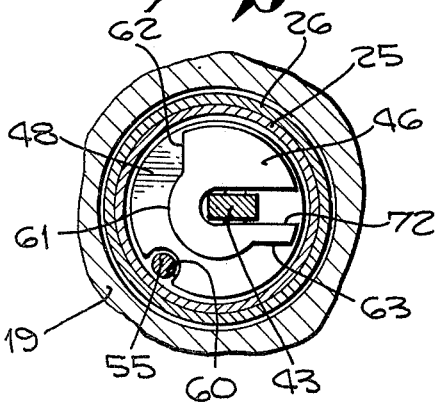
FIG. 15, is a cross-sectional view on the line 15—15 of FIG. 12.

Should it now become desirable to unlock the dead bolt from the inside of the door, a duplicate key 43 is then inserted into the keyway 32. The cut end of the key, however, cannot now enter the key drive slot 72 of the inside tailpiece because of its being out of alignment, as shown in FIGS. 18 and 19. The end of the key, however, is pushed against the head 46 and the head together with the inside tailpiece 40 yields, moving inwardly as viewed in FIG. 18, against tension of the conical coil spring 49 to the position of FIG. 18. Movement through that distance is sufficient to allow full insertion of the key 43 to a position where the junction between top and bottom pins coincide with the shear line 70. The key, together with the cylinder plug 25 can then be rotated, counterclockwise as viewed in FIG. 19 until it is in alignment with the key drive slot 72. In that position the conical coil spring 49 presses the inside tailpiece 40 in a direction toward the key until the key drive slot 72 is in engagement with the cut end of the key as shown in FIG. 12. When the key 43 is then rotated in a clockwise direction, as viewed in FIGS. 19 and 20, the inside tailpiece 40 directly driven by the key causes return of the head 46 and inside tailpiece 40 through a dead bolt withdrawing motion to withdrawn position, as shown in FIG. 20. In the alternative, the bolt may be withdrawn by rotating the key 43 in the retract direction whereby the micropin 55 contacts the lost motion stop 62 on the tailpiece head 46 thereby driving the mechnaism to the retracted position, but in this mode the key tip does not engage in the slot 72.

Under still another circumstance, let it be assumed that the dead bolt has been locked in extended position by operation of a key 43 from the inside, the key remaining in the keyway 32. Should a duplicate of key 43 then be inserted in the outside trim causing the outside tailpiece 42 to be rotated, rotating the dead locking hub 41, the inside tailpiece 40 is likewise rotated because of being carried in the locking hub. As the key is engaged in key drive slot 72 and corresponding keyway 32, the inside cylinder plug 25 rotates back to initial position, carrying with it the key 43 which has been left in the corresponding keyway 32.

The captive key mechanism described is fail safe in that should the conical coil spring 49 fail, and no longer press the inside tailpiece 40 and its head 46 in a direction toward a key 43, to a position for example of abutting the cylinder plug 25 at the bottom of the counter bore, the inside mechanism can continue to function as a standard cylinder, allowing normal locking and unlocking. The only difference under the last defined circumstance, is that after the dead bolt has been extended to locked position, the key 43 can return the cylinder plug 25 to the initial vertical position permitting withdrawal of the key, without unlocking the dead bolt.

I claim:

1. A captive key mechanism for a dead bolt lock wherein the dead bolt lock consists of a latch bolt subassembly with a latch bolt and a rotatable hub for extending and retracting the latch bolt, an outside key actuated trim, and inside key actuated trim, and hub actuating means extending between said trims, and wherein the inside key actuated trim includes a cylinder, a cylinder plug rotatable therein at a shear line and tumblers extendable past the shear line between the cylinder and the cylinder plug, said mechanism comprising means defining a space at the inner end of the cylinder plug, said hub actuating means having one part thereof in engagement with the hub, spring means biasing another part of said hub actuating means into said space, a retainer acting between the cylinder plug and the cylinder for holding the cylinder plug in the cylinder and a driver attached to the inner end of the cylinder plug and having a nonrotatable engagement with the retainer, there being circumferentially spaced stop means on the hub actuating means engageable with said driver alternatively in opposite directions of rotation of the cylinder plug for rotating said hub actuating means in response to action of the inside key actuated trim.

2. A captive key mechanism for a dead bolt lock wherein the dead bolt lock consists of a latch bolt subassembly with a latch bolt and a rotatable hub for extending and retracting the latch bolt, an outside key actuated trim, an inside key actuated trim, and hub actuating means extending between said trims, and wherein the inside key actuated trim includes a cylinder, a cylinder plug rotatable therein at a shear line and tumblers extendable past the shear line between the cylinder and the cylinder plug, said mechanism comprising means defining a space at the inner end of the cylinder plug, said hub actuating means having one part thereof in engagement with the hub, spring means biasing another part of said hub actuating means into said space, a retainer acting between the cylinder plug and the cylinder for holding the cylinder plug in the cylinder and a driver attached to the inner end of the cylinder plug and having a nonrotatable engagement with the retainer, there being circumferentially spaced stop means on the hub actuating means engageable with said driver alternatively in opposite directions of rotation of the cylinder plug for rotating said hub acctuating means in response to action of the inside key actuated trim, a pat of said hub actuating means having a head with a key drive slot therein.

3. A captive key mechanism as in claim 2 wherein said part of said hub actuating means has a substantially flat form at one location and said key drive slot is in transverse position relative to said flat form.

4. A captive key mechanism as in claim 3 wherein said stop means is on the circumference of said head and at a position wherein when in engagement with the driver, said key drive slot is in alignment with a keyway in said cylinder plug.

5. A captive key mechanism for a dead bolt lock wherein the dead bolt lock consists of a latch bolt subassembly with a latch bolt and a rotatable hub for extending and retracting the latch bolt, an outside key actuated trim, an inside key actuated trim, and hub actuating means extending between said trims, and wherein the inside key actuated trim includes a cylinder, a cylinder plug rotatable therein at a shear line and tumblers extendable past the shear line between the cylinder and the cylinder plug, said mechanism comprising means defining a space at the inner end of the cylinder plug, said hub actuating means having one part thereof in engagement with the hub, spring means biasing another part of said hub actuating means into said space, a retainer acting between the cylinder plug and the cylinder for holding the cylinder plug in the cylinder and a driver attached to the inner end of the cylinder plug and having a nonrotatable engagement with the retainer, there being circumferentially spaced stop means on the hub actuating means engageable with said driver alternatively in opposite directions of rotation of the cylinder plug for rotating said hub actuating means in response to action of the inside key actuated trim, the space being in the cylinder plug, there being a threaded exterior around said space for engagment with said retainer.

6. A captive key mechanism as in claim 5 wherein there is a pocket in the cylinder plug for reception of said driver, spring means in said pocket adapted to bias said driver in a direction outwardly of said pocket and recess means in said retainer in alignment with said pocket for releasable retention of said driver whereby to lock said retainer in position.

7. A captive key mechanism for a dead bolt lock wherein the dead bolt lock consists of a latch bolt subassembly with a latch bolt and a rotatable hub for extending and retracting the latch bolt, an outside key actuated trim, an inside key actuated trim, and hub actuating means extending between said trims, and wherein the inside key actuated trim includes a cylinder, a cylinder plug rotatable therein at a shear line and tumblers extendable past the shear line between the cylinder and the cylinder plug, said mechanism comprising means defining a space at the inner end of the cylinder plug, said hub actuating means having one part thereof in engagement with the hub, spring means biasing another part of said hub actuating means into said space, a retainer acting between the cylinder plug and the cylinder for holding the cylinder plug in the cylinder and a driver attached to the inner end of the cylinder plug and having a nonrotatable engagement with the retainer, there being circumferentially spaced stop means on the hub actuating means engageable with said driver alternatively in opposite directions of rotation of the cylinder plug for rotating said hug actuating means in response to action of the inside key actuated trim, said spring means for biasing the tailpiece being a coil spring in said space and surrounding said tailpiece, and spring keeper washers at opposite ends of said coil spring having circumferentially located notches for reception of said driver.

* * * * *